US005713216A

United States Patent [19]

Erickson

[11] Patent Number: 5,713,216

[45] Date of Patent: Feb. 3, 1998

[54] COILED TUBULAR DIABATIC VAPOR-LIQUID CONTACTOR

[76] Inventor: Donald C. Erickson, 1704 S. Harbor La., Anapolis, Md. 21401

[21] Appl. No.: 468,128

[22] Filed: Jun. 6, 1995

[51] Int. Cl.[6] ..... F25B 15/00; F25B 15/12; F28D 7/02

[52] U.S. Cl. ..... 62/476; 62/484; 62/485; 165/163; 165/DIG. 406

[58] Field of Search ..... 62/476, 484, 485, 62/494; 165/163, 172, 910, DIG. 163, DIG. 164, DIG. 165, DIG. 172, DIG. 173, DIG. 174, DIG. 175, DIG. 355, DIG. 406, DIG. 441, DIG. 453, DIG. 522, DIG. 535

[56] References Cited

U.S. PATENT DOCUMENTS

| | | | |
|---|---|---|---|
| 2,365,791 | 12/1944 | Wineman | 165/163 |
| 2,970,812 | 2/1961 | Kritzer | 165/163 |
| 3,006,612 | 10/1961 | Herbert | 165/163 |
| 3,513,908 | 5/1970 | Singh | 165/163 |
| 3,533,467 | 10/1970 | Rummel | 165/163 |
| 4,651,819 | 3/1987 | Yumikura et al. | 165/115 |
| 4,718,237 | 1/1988 | Sterlini | 60/673 |
| 5,067,330 | 11/1991 | Cook et al. | 62/485 |

*Primary Examiner*—William Doerrler

[57] ABSTRACT

A non-diabatic vapor-liquid contact device is disclosed which achieves high heat transfer effectiveness without sacrificing mass transfer effectiveness. Referring to FIG. 2, a helical coil of crested tubing 84 is contained within the annualr space between shrouds 82 and 83. Liquid flows downward through the annulus, and vapor flows counter-currently upward. The mass exchanging fluids pass through the space between tube crests and the shroud, achieving very effective mixing. Heat transfer fluid is flowed through the tubing via connections 87 and 88.

The heat and mass transfer is preferably additionally enhanced by interspersing contact media with the coiled tubing, either longitudinally or radially.

28 Claims, 9 Drawing Sheets

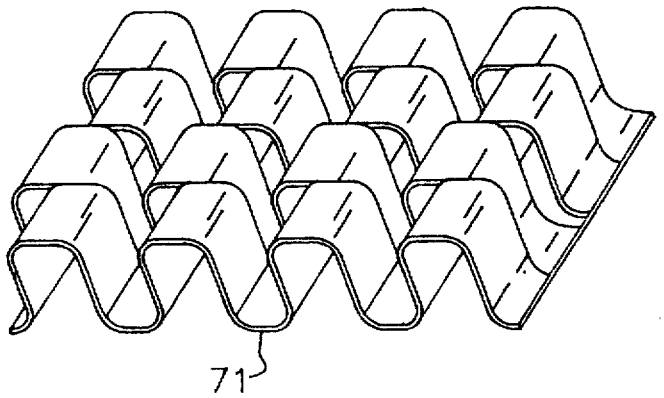
FIG. 3 A
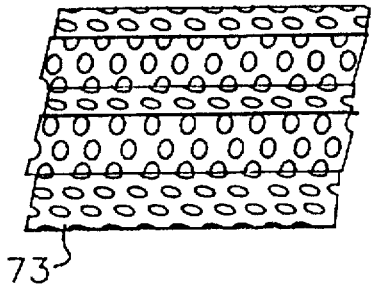
FIG. 3 B
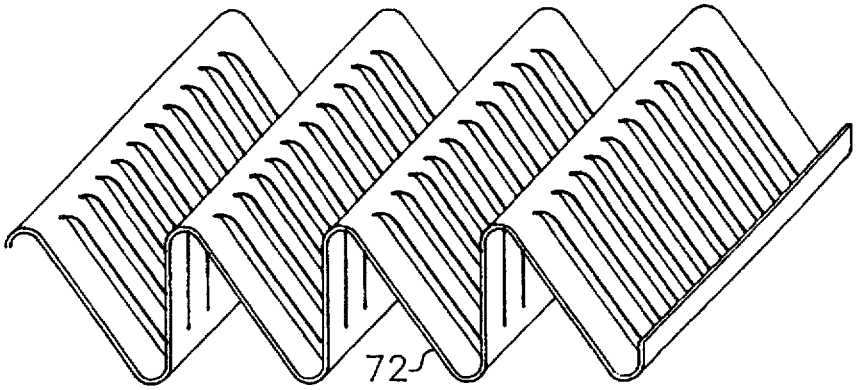
FIG. 3 C
FIG. 3 D
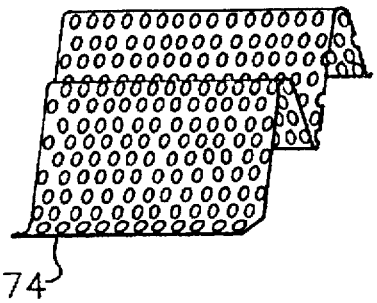
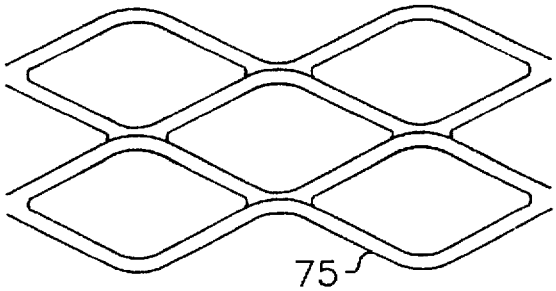
FIG. 3 E

COILED TUBULAR DIABATIC VAPOR-LIQUID CONTACTOR

TECHNICAL FIELD

A vapor liquid contact apparatus is disclosed which effectively exchanges heat with the fluids undergoing mass transfer, i.e. accomplishes diabatic mass transfer. Diabatic mass transfer is an important component of many processes, ranging from fractional distillion and absorption to desorption and evaporation.

BACKGROUND ART

Conceptually adiabatic mass exchanger is simply the combination of a heat exchanger plus a mass exchanger. However effective mass exchange has very exacting requirements, relating to liquid distribution, mixing of bulk flows, and achievement of vapor-liquid contact surface. Most straightforward combinations of known heat exchangers with known mass exchangers cause a marked degradation in the expected mass exchange.

Nonetheless, there is a substantial benefit to identifying and implementing those few combinations which do yield effective diabatic mass exchange, for the processes using them can achieve major efficiency gains and size reductions.

Diabatic fractionators have been referred to as "reflux heat exchangers", "reflux condensers", or as "dephlegmators." Prior art embodiments have generally been the plate fin type, as disclosed in U.S. Pat. Nos. 3,508,412; 3,625,017; and 5,316,628. Note also U.S. Pat. No. 5,410,885.

One special case of diabatic mass exchange is found in absorption heat pumps. Prior art examples of diabatic mass exchangers in absorption heat pumps are found in U.S. Pat. Nos. 4,127,009; 4,688,399; 5,282,507; 5,367,884; and 5,339,654.

Two cases can be distinguished, according to whether the less volatile component (the sorbent) is non-volatile, in which case the vapor is single component, or the sorbent is volatile, i.e. the vapor is multicomponent. Countercurrent mass exchange becomes very important in most vapor-liquid contact operations with volatile sorbents.

Whereas most prior art disclosed embodiments of diabatic mass exchangers have been the plate fin type, some have been shell and tube (U.S. Pat. No. 5,255,528), and some have been helically coiled tubing.

The various prior art embodiments generally have one or more shortcomings: insufficient liquid distribution; insufficient bulk mixing of liquid and/or of vapor; excessive fluid inventory; costly and difficult construction practices; and/or not suitable for countercurrent vapor-liquid contact. What is needed, and among the objects of this invention, are process and apparatus for diabatic mass exchange which efficiently establishes and maintains good liquid distribution and wetting; which achieves enhanced vapor-liquid mass transfer owing to bulk mixing of the vapor and liquid coupled with effective heat exchange; reduced fluid inventory; and which is easily manufacturable from readily available components

DISCLOSURE OF INVENTION

It has now been discovered that diabatic mass exchange can be beneficially conducted using a coiled tubular configuration in combination with at least one of shrouds and sheet or strip contact media.

When used with shrouds, the coiled tubing is crested, for example by fluting, finning, indentations, corrugations, or the like. In that way the shrouds can be tightly pressed against both the external and internal surface of the coil, and the valleys between crests allow for fluid passage. With helical cresting (also called spiral cresting), as opposed to radial cresting, the tubing has been found to provide excellent liquid distribution characteristics: most drip points on the top of the tube will result in two or more drip points from the bottom of the tube. The adherent shrouds function to keep the liquid confined to the same coil/channel, so it cannot escape to and concentrate at some other coil. At the same time the shrouds provide additional vapor-liquid contact surface, and owing to the points of thermal contact with the tubing, also additional heat transfer surface. Heat transfer medium is flowed through the coiled tubing, and the desired vapor-liquid contact and mass exchange takes place outside the tubing, in the annular space formed by the shrouds.

The shrouded coiled crested tube diabatic mass exchange configuration has been found to be especially effective in countercurrent flow vapor-liquid contact. The apparatus is mounted with the coil axis vertical, and with liquid flowing down from the top of the coil and vapor flowing up from the bottom. The total fluid flow area, determined by the coil diameter and the crest geometry, is sized large enough that flooding does not occur, i.e. that countercurrent vapor-liquid flow occurs through each valley between crests. The geometry of the crests and valleys can be varied over the height of the mass exchanger to accommodate differing fluid rates.

Several different countercurrent vapor-liquid contact examples or situations can be distinguished for which this diabatic mass exchanger provides benefits. The most general is where liquid is distributed to the top of the coil, vapor is distributed to the bottom, and a different vapor is removed from the top, and a correspondingly different liquid is removed from the bottom. When the temperature gradient gets hotter from the top of the coil to the bottom, this represents fractional distillation (more volatile substance at top). When heat is supplied from the tubing to the mass exchange process, it is the stripping portion of distillation, and when heat is removed, it is the rectification portion of distillation.

When no vapor is withdrawn from the top, and when the liquid supplied at the top is the lower volatility feed, such that the temperature gradient gets colder from top to bottom, then the process is termed absorption. If vapor is withdrawn from the top, with the reversed temperature gradient (hot at top), it is called reverse distillation.

For both the "cold at top" and "hot at top" configurations, other applications are possible for any of the following variants: no liquid supplied to the top; no vapor supplied to the bottom; and no liquid withdrawn from the bottom.

Yet additional cases of interest for this diabatic mass exchanger are:

1) cocurrent downflow, where the vapor is the continuous phase; and
2) cocurrent upflow, where the liquid is the continuous phase.

The latter yields particularly enhanced performance owing to the continuously renewing surfaces surrounding each vapor bubble.

In most applications of interest, especially those processes where cooling is supplied via the tubing coil, and hence there is a net transfer of mass from the vapor phase to the liquid phase, i.e. an absorption or condensation, it is found that the transfer resistance outside the tubing is substantially larger than that inside—typically by a factor of 5 to 10. This is partly owing to the increase in resistance due to vapor phase mass transfer, i.e. the severe composition gradients that occur especially in the vapor phase. For those circumstances, it has been found particularly beneficial to enhance the mass transfer process by interspersing mass transfer contact media with the tubing, e.g. between adjacent rows or coils of tubing. The mass transfer media is designed to provide a very large multiplicity of small dimension openings—many more than is possible with the tubing, since much of the tubing volume is necessarily devoted to transport space for the internal fluid. Hence a great deal of turbulence and mixing of both the vapor and liquid phases occurs as they transverse the contact media, whether cocurrently or countercurrently. Also, owing to some degree of thermal contact with the tubing and with the shroud, the contact media provides some degree of heat exchange in addition to the major improvement in mass exchange. Hence the interspersed combination of tubing plus contact media accomplishes more mass exchange than the same volume of tubing alone. Further it is less expensive, since the contact media is less costly than crested tubing. Finally there is less pressure drop on the tube side, since only half or less length of tubing is used for the same mass exchange.

The preferred form of interspersed vapor-liquid contact media is in strip form, such that it can be coiled in the same manner as and adjacent to the crested tubing. Preferably it is fin material, with the fin height extending from inner shroud to outer shroud, such that the fin crests are in thermal contact with the shrouds. Especially preferred is when the fin crests are brazed to the shrouds, and also the tubing crests.

Whereas the description thus far has for clarity described only a single coil, there will frequently be multiple concentric helical coils in a pressure vessel, with the outer shroud of one coil forming the inner shroud of the next larger coil. Also, each coil can when appropriate be formed from more than one parallel strands of tubing. All tubes may be supplied the same heat transfer fluid; but also when appropriate different tubes can be supplied with different heat transfer fluids—whether different coils or different strands of the same coil.

In some instances it will be beneficial to have the coils have smaller diameters at one end than the other, i.e. have a truncated conical shape vice right circular cylinder. This accommodates changing fluid duties (lower duty at smaller end) and also facilitates assembly—each completed shroud can be readily slipped over its coil. Another beneficial means of accomodating different duties at different heights is to vary the crest and valley geometry of the tubing at different heights—with deeper valleys allowing greater fluid duties.

Most prior art diabatic mass exchangers exchange sensible heat only to or from the heat transfer medium. However the embodiment disclosed herein explicitly extends to a latent-to-latent exchange. In the case of a cooling diabatic mass exchanger, the heat is preferably transferred to a cocurrent desorbing sorbent mixture in the tubing, and in the case of a heating diabatic mass exchanger, the heat is transferred from a cocurrent absorbing sorbent mixture in the tubing or from a condensing vapor. The former example has particular application to GAX absorption cycles.

In addition to interspersing helically coiled strip contact media longitudinally with the coiled crested tubing, as described above, it is also possible to intersperse the contact media radially with coiled tubing. This provides the advantage that the tubing can be smooth walled, i.e. without crests. However the fluids no longer flow around each coil, i.e. heat exchange is hindered. Accordingly the tubing is preferably fashioned with flat sides, and the contact media is provided with fins which achieve good thermal contact with the tubes. Shrouds may also be used to help maintain even liquid distribution; however when the tubing is tightly coiled, it functions as a shroud, obviating the need for separate shrouds.

In yet another embodiment the combination heat and mass exchanger disclosed herein is comprised of:

a) a helical coil of tubing;

b) a means for supplying heat transfer fluid to said coil;

c) a containment for said coil d) a means for supplying mass transfer fluids to said containment for contact with said tubing coil; and e) at least one of i) a cylindrical shroud pressed against a surface of said tubing coil; and ii) contact media radially interspersed with said tubing coil.

BRIEF DESCRIPTION OF THE DRAWINGS

FIGS. 3A–3E illustrate several example types of contact media suitable for use in sheet or strip form in this invention.

BEST MODE FOR CARRYING OUT THE INVENTION

Figure 1A:
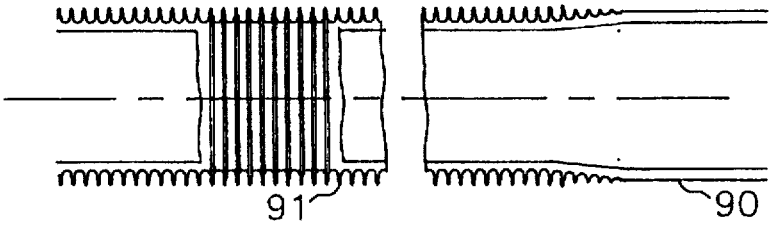
FIGS. 1A–1D illustrate example types of crested tubing.
Figure 1B:
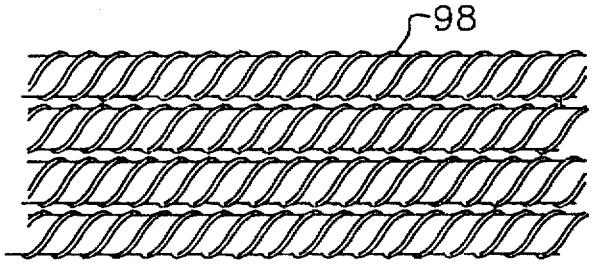
Figure 1C:
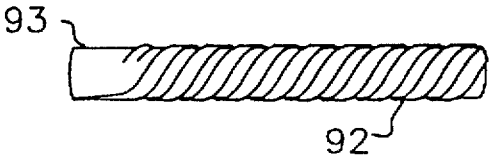
Figure 1D:
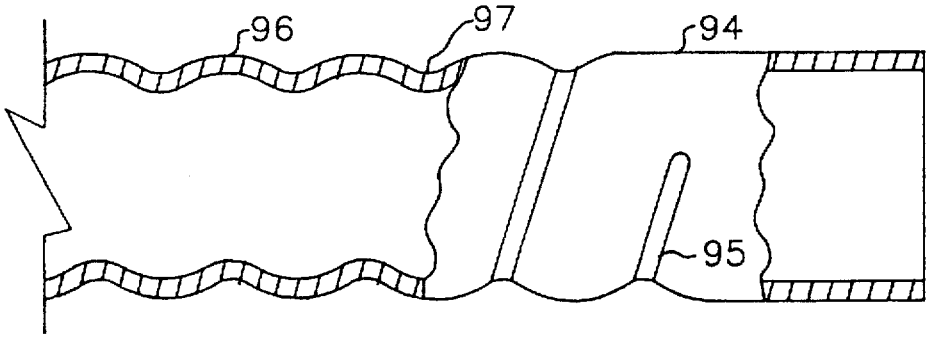

FIG. 1 illustrates three commonly encountered types of crested tubing. Tube 90 has fins 91 helically machined onto its outer surface. The same effect can be obtained by spirally wrapping separate fin material around the tube. Tube 93 has been mechanically twisted to cause multiple flutes 92 to appear. Tube bank 98 consists of multiple parallel pieces of that fluted tubing. Tube 94 has been spirally mechanically indented (indentation 95), thereby forming crests 96 and valleys 97. When the same indentation is applied radially vice spirally, it is sometimes referred to as corrugated tubing.

Figure 2:
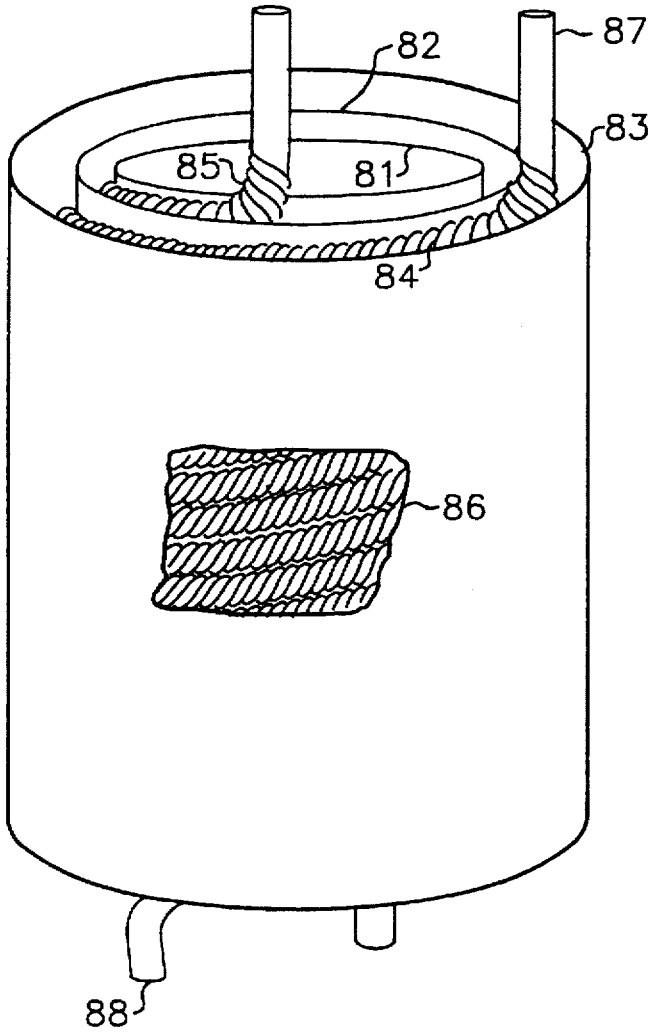
FIG. 2 illustrates a shrouded crested coiled tube configuration.

FIG. 2 illustrates three cylindrical shrouds 81, 82, and 83 plus two coils of crested tubing 84 and 85 which are annularly enclosed by the shrouds. Shroud 82 is both the outer shroud for tubing coil 85 and the inner shroud for tubing coil 84.

Cutaway 86 illustrates several rows of coil 84. Ports 87 and 88 supply heat transfer fluid to the inside (tube side) of coil 84. The shrouds are preferably sheet metal, rolled or bent into the conforming shape (cylindrical or truncated cone, as the case may be). The shrouds are preferably in thermal contact with their associated tube coils. The shrouded helically coiled crested tube configuration of FIG. 2 is illustrated with two concentric coils, but any other number of coils is possible, including one.

FIG. 3 illustrates the preferred forms of vapor-liquid contact media to be used as sheet or strip interspersed with the tubing. Shape 71 is lanced offset strip fin. Shape 72 is louvered fin. Shapes 73 and 74 are perforated metal, partially folded toward the fin configuration. Shape 75 is expanded metal, which also can be folded into fin configuration. The preferred fin configuration has a high fin density, ranging from 200 to 800 fins per meter.

Figure 4A:
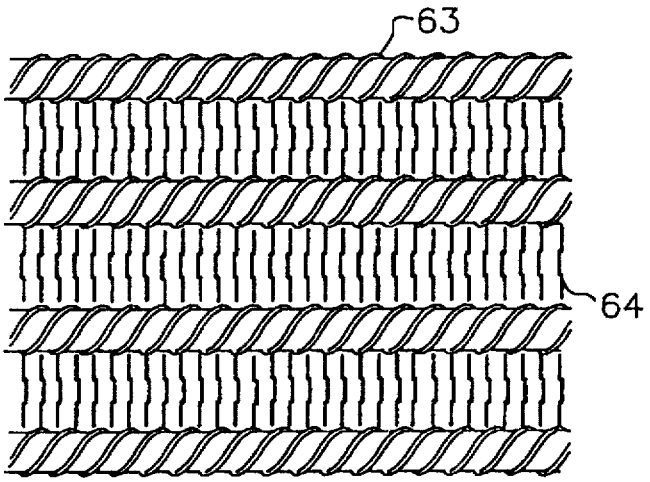
FIGS. 4A–4C illustrate the interspersal of crested tubing and contact media in alternating rows, i.e. longitudinally interspersed.
Figure 4B:
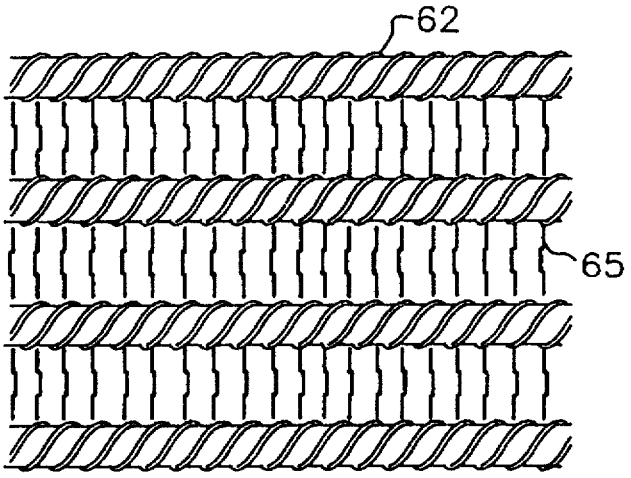
Figure 4C:
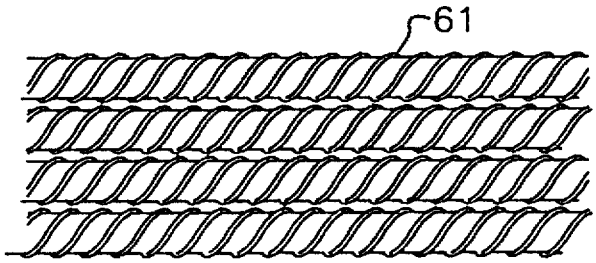

FIG. 4 illustrates mockups of parallel rows of fluted tubing, such as would be present in the annular space between an inner and outer shroud. Configuration 61, comprised of tubing only, is descriptive of the tubing arrangement present in FIG. 2. Configurations 62 and 63 illustrate the interspersal of strip contact media (lanced offset fin strips 64 and 65) with the tubing. Strip media 64 has a higher fin count than strip contact media 65.

Figure 5:
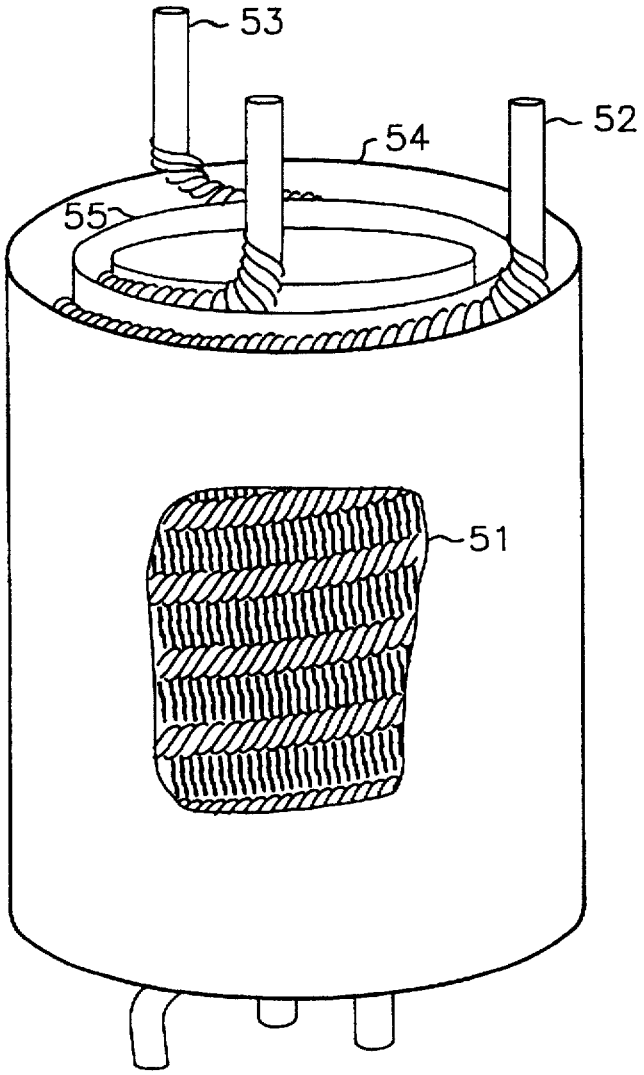
FIG. 5 illustrates the shrouded crested coiled tube configuration, with longitudinally interspersed strip contact media, and also with two tubing strands in the outer coil.

FIG. 5 illustrates a shrouded coiled crested tube configuration similar to FIG. 2 but with two changes: long strip of contact media have been longitudinally interspersed with the tubing, as shown at cutaway 51; and also the outer coil has two strands of tubing, 52 and 53. Thus liquid traversing downward between shrouds 54 and 55 will sequentially encounter the first tube strand, contact media, the second tube strand, contact media, and then keep repeating in that order. The heat transfer occurring at each tube contact pulls the liquid further away from equilibrium, and then the mixing at the subsequent media contact restores it closer to equilibrium. The two strands can optionally be supplied with the same heat transfer fluid or different.

Figure 6A:
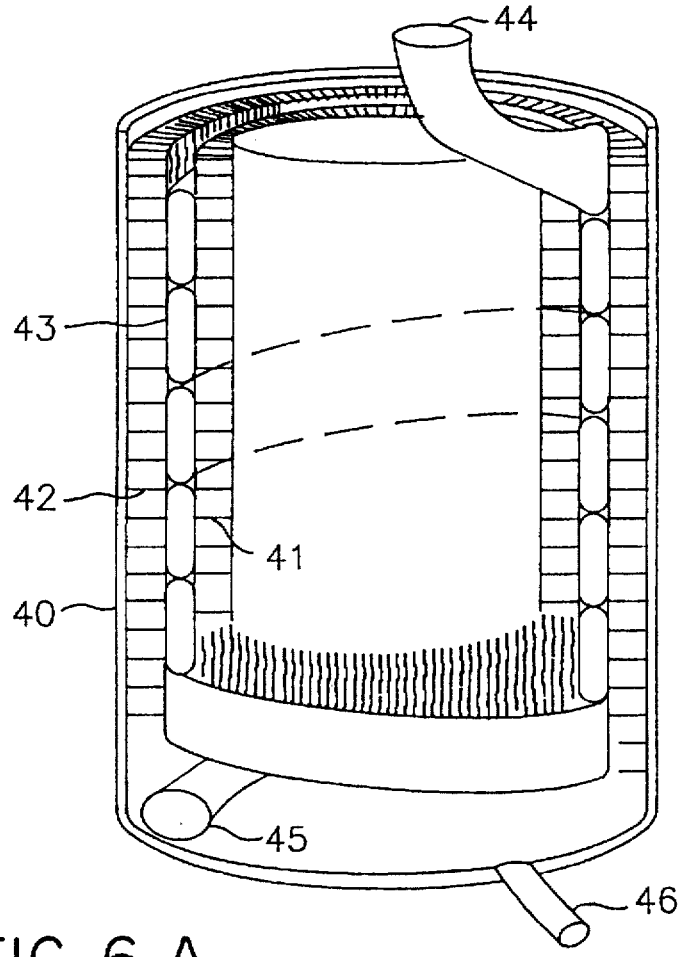
FIGS. 6A and 6B illustrate radially interspersed sheet contact media in conjunction with coiled smooth wall tubing having flat sides.
Figure 6B:
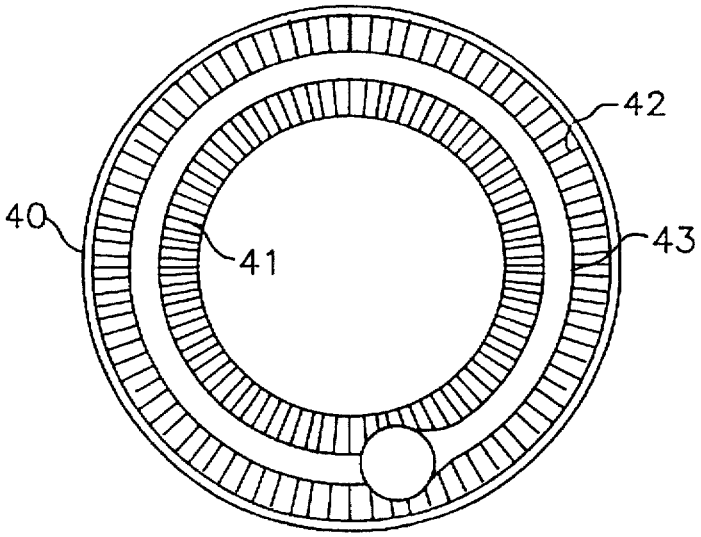

FIG. 6 illustrates an alternative method of interspersing contact media with coiled tubing, so as to obtain the benefit of reduced vapor-liquid transfer resistance during diabatic mass exchange. In FIG. 6 the contact media 41 and 42 is in sheet form and is radially interspersed with the tube coil 43. Sheet 41, in thermal contact with the inner surface of coil 43, is at a smaller radius, and sheet 42 is at a larger radius. Containment 40 contains the coil and the contact media. The tube coil has inlet and outlet connections 44 and 45, and the containment includes fluid ports such as port 46.

Figure 7:
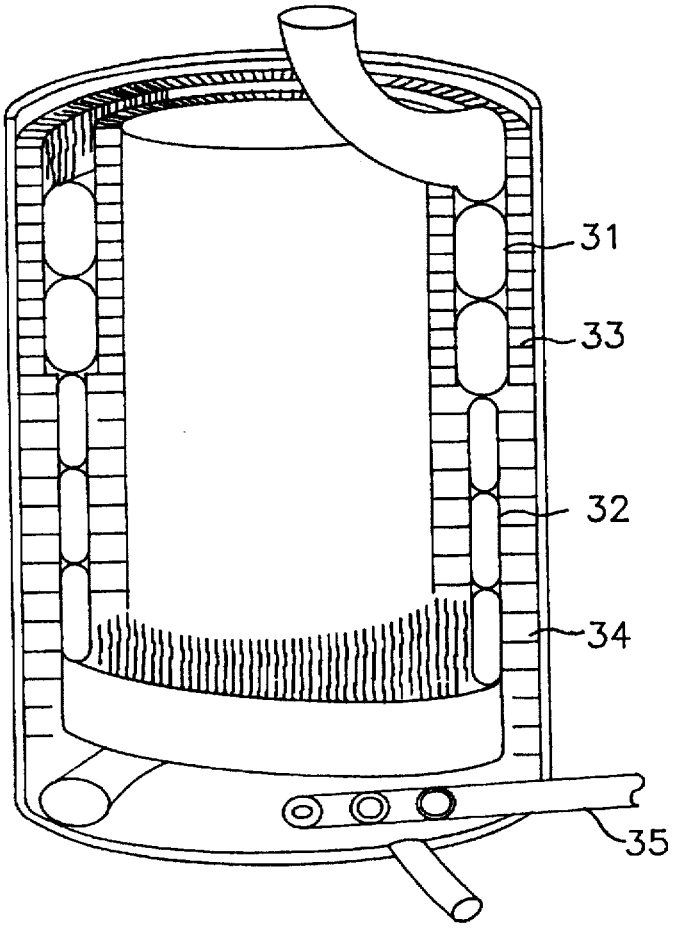
FIG. 7 illustrates the radially interspersed packing/smooth wall coiled tubing configuration wherein the tube diameter is stepped to accomodate vertically changing fluid duties outside the tubing.

FIG. 7 illustrates another embodiment of the radially interspersed combination of tube coil and contact media: the tube coil is comprised of a larger diameter segment 31 and a smaller diameter segment 32, i.e. is stepped. Correspondingly the sheet contact media is comprised of a lower fin height section 33 and a higher fin height section 34. This stepped arrangement accommodates decreasing fluid duties (volumetric flowrates) with height on the shell side, where absorption is occurring, and also accommodates increasing volumetric flowrates on the tube side, where desorption is occurring. In this example the heat transfer fluid is a desorbing solution. This configuration is particularly advantageous as the generator-absorber heat exchange (GAX) component of a GAX absorption cycle. Vapor distributor 35 supplies vapor to the bottom of the absorbing side of this GAX component.

Figure 8:
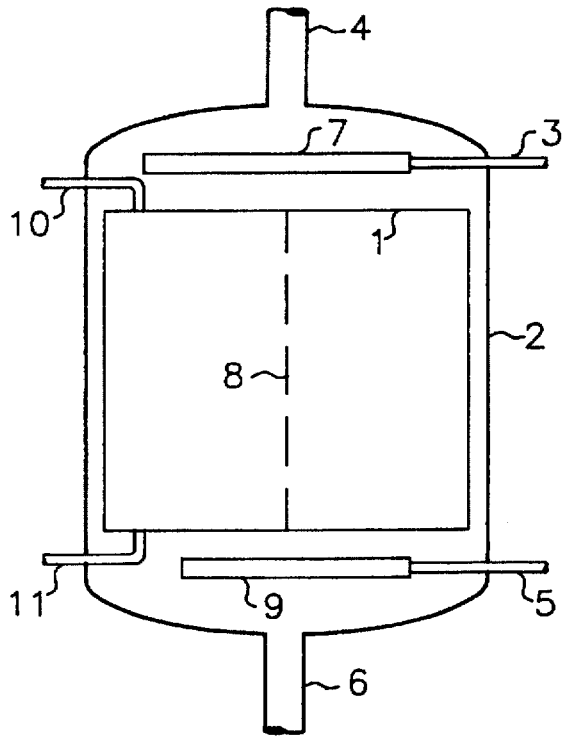
FIG. 8 illustrates different modes of application for the vertically coiled tubing mass exchanger with shrouds and/or contact media.

FIG. 8 illustrates different modes of application of the various coiled tube configurations combined with shrouds and/or contact media described above. The coiled tube configuration 1 is positioned within containment 2 (e.g. a pressure vessel) such that the tube coil axis 8 is approximately vertical. For countercurrent vapor-liquid mass transfer, liquid is supplied to the top of the outside of the coil via port 3 and liquid distributor 7. Vapor is supplied to the bottom of the outside of the coil via port 5 and distributor 9. Heat transfer fluid is supplied to and from the inside of the tube via ports 10 and 11. Product fluid is withdrawn from overhead port 4, and product liquid is withdrawn from bottom port 6. As explained earlier, dependent upon the particular application, the fluid duty through any one of ports 3, 4, 5, and 6 may be set to zero. Also the heat transfer fluid may flow either direction between ports 10 and 11, and also may either supply heat or remove heat.

For cocurrent applications, in the upflow mode liquid is supplied to port 6 and vapor to port 5, and liquid (plus optionally some vapor) is withdrawn from port 4. In the downflow mode both fluids are supplied at the top, and liquid is withdrawn from the bottom.

Figure 9:
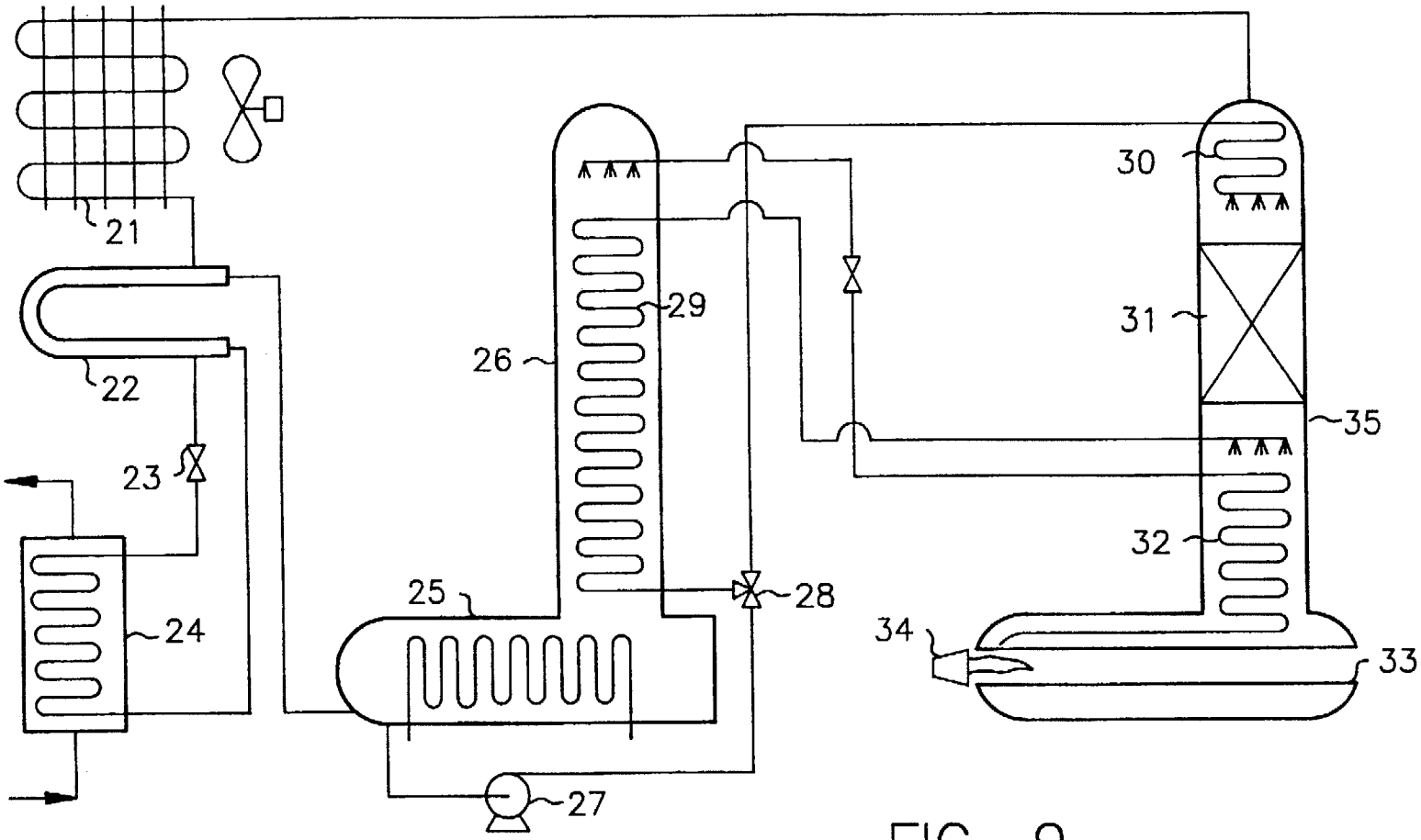
FIG. 9 is a simplified schematic flowsheet of a GAX absorption cycle illustrating locations where the disclosed invention can beneficially be applied.

FIG. 9 is a schematic flowsheet of a basic generator-absorber heat exchange (GAX) absorption cycle apparatus, adapted for operation with aqueous ammonia working fluid. Liquid ammonia condensate from condenser 21 is routed through refrigerant heat exchanger 22, refrigerant pressure letdown 23, and into evaporator 24. Evaporated low pressure refrigerant is routed back through RHX 22 to externally cooled absorber 25 and thence to GAX absorber 26. Weak absorbent solution (i.e. having high $NH_3$ content) is withdrawn from the cold end of absorber 25 and pressurized by solution pump 27. It is split by splitter 28, with part routed to GAX desorption coil 29 and another part routed to solution cooled rectifier coil 30. The latter stream after heating is distributed onto adiabatic vapor-liquid contact media 31, then joined with the effluent from coil 29 and distributed over the diabatic mass transfer section 32 (also known as the generator heat exchanger). Finally the remaining mass exchanged liquid reaches the horizontal fire tube generator 33, which is heated by burner 34. Vapor traversing upward through distillation column 35 steadily increases in flow rate and in ammonia concentration until it reaches more than 99% purity, when it is withdrawn and routed to condenser 21, completing the cycle.

The disclosed helically coiled tubing with shrouds and/or with interspersed contact media can be beneficially applied as the GAX component (29 and 26), the solution cooled rectifier 30, and the generator heat exchanger 32. All three of those components require shell-side non-adiabatic countercurrent vapor-liquid mass exchange, which is very advantageously supplied as disclosed herein.

One additional important advantage of the shrouds is that, due to thermal contact with more than one coil, they can compensate for fluid maldistribution which may be present, helping to balance the thermal load.

I claim:

1. Apparatus for vapor-liquid contact comprising:

a) at least one coil of crested tubing;

b) an inner shroud in thermal contact with the inner surface of said coil;

c) an outer shroud in thermal contact with the outer surface of said coil;

d) a means for supplying volatile mass transfer sorbent liquid and vapor to countercurrent thermal contact with said coil outside said tubing;

e) a means for flowing heat transfer fluid through said tubing; and f) a means for withdrawing mass transfer fluid from one end of said coil outside said tubing.

2. Apparatus according to claim 1 additionally comprised of a pressure vessel containing said coil.

3. Apparatus according to claim 2 wherein said pressure vessel serves as said outer shroud.

4. Apparatus according to claim 1 comprising multiple concentric radially spaced coils and wherein the inner shroud of one coil is also the outer shroud of the next smaller coil.

5. Apparatus according to claim 1 wherein said crested tubing is fluted twisted tubing.

6. Apparatus according to claim 1 wherein said crested tubing is spirally indented tubing.

7. Apparatus according to claim 4 wherein said crested tubing is helically externally finned tubing.

8. Apparatus according to claim 1 wherein said coil axis is vertical and said means for supplying liquid is at the top end, whereby liquid travels downward by gravity between the shrouds and external to the coil.

9. Apparatus according to claim 1 wherein said coil is in the shape of a hollow cylinder.

10. Apparatus according to claim 9 wherein said cylinder is a right circular cylinder.

11. Apparatus according to claim 1 wherein said coil is a conical section shape.

12. Apparatus according to claim 4 additionally comprised of a pressure vessel for containing said coils, and wherein said coils and said shrouds are of right circular cylindrical shape, and said tubing is twisted fluted tubing.

13. Apparatus according to claim 1 additionally comprised of a helically coiled strip of vapor-liquid contact media which is concentrically and co-radially coiled with said tubing, whereby fluids traversing axially between said shrouds alternately encounter tubing and contact media in repeating sequence.

14. Apparatus according to claim 13 wherein said contact media is folded fin.

15. Apparatus according to claim 14 wherein said folded fin is lanced offset fin.

16. Apparatus according to claim 14 wherein the crests of said fin are brazed to said shrouds.

17. Apparatus according to claim 13 wherein said contact media is comprised of expanded metal.

18. A vapor-liquid contact apparatus comprised of:

a) at least two helical coils of heat transfer tubing;

b) structured contact media in alternating sequence with the coils;

c) a shroud in thermal contact therewith one coil and its associated contact media.

19. The apparatus according to claim 18 wherein the tubing has flattened sides and is not crested, and wherein the contact media is radially spaced from the coils.

20. The apparatus according to claim 18 wherein the tubing is crested whereby flow passages are created between the shroud and the backing coil, and wherein the vapor-liquid contact is countercurrent.

21. Apparatus according to claim 18 additionally comprised of a multicomponent fluid inside said tubing which is boiling.

22. A combination heat and mass exchanger comprised of:

a) a helical coil of tubing;

b) a means for supplying heat transfer fluid to said coil;

c) a containment for said coil d) a means for supplying mass transfer fluids to said containment for contact with said tubing coil; and e) contact media interspersed with said tubing coil.

23. The exchanger according to claim 22 additionally comprised of mountings for said coil and said containment which position the coil axis vertically.

24. The exchanger according to claim 23 additionally comprised of a cylindrical shroud pressed against both the inner and outer surface of said tubing coil, and wherein said tubing is crested.

25. The exchanger according to claim 24 additionally comprising at least one of a) a liquid supply to the top of said containment;

b) a liquid withdrawal from the bottom of said containment.

26. The exchanger according to claim 22 wherein said tubing has flattened sides which are in thermal contact with said interspersed contact media.

27. The exchanger according to claim 26 wherein said coil is stepped such that the tubing width is greater at one end than the other.

28. The exchanger according to claim 22 used as a generator-absorber heat exchange component in a GAX absorption cycle apparatus.

* * * * *